US007993469B1

(12) United States Patent
Vallapuzha et al.

(10) Patent No.: US 7,993,469 B1
(45) Date of Patent: Aug. 9, 2011

(54) SENSOR BASED MICRO-CLEANING OF BURIED INFRASTRUCTURE

(75) Inventors: Subramanian Vallapuzha, Pittsburgh, PA (US); Scott M. Thayer, Pittsburgh, PA (US); Eric C. Close, Sewickley, PA (US); Brian Bannon, Milford, CT (US); Sam E. Cancilla, Cranberry, PA (US); Adam Slifko, Pittsburgh, PA (US); Carlos Felipe Reverte, Miami, FL (US); Prasanna Kumar Velagapudi, Suffern, NY (US)

(73) Assignee: RedZone Robotics, Inc., Pittsburgh, PA (US)

( * ) Notice: Subject to any disclaimer, the term of this patent is extended or adjusted under 35 U.S.C. 154(b) by 280 days.

(21) Appl. No.: 11/600,315

(22) Filed: Nov. 15, 2006

Related U.S. Application Data

(60) Provisional application No. 60/737,171, filed on Nov. 15, 2005.

(51) Int. Cl.
*B08B 9/04* (2006.01)

(52) U.S. Cl. ..... 134/22.11; 134/8; 134/18; 134/26

(58) Field of Classification Search ..... 134/18, 134/22.1, 22.11
See application file for complete search history.

(56) References Cited

U.S. PATENT DOCUMENTS

| | | | | |
|---|---|---|---|---|
| 3,732,701 | A * | 5/1973 | Lynch | 405/162 |
| 4,025,360 | A * | 5/1977 | Horne et al. | 134/24 |
| 4,285,239 | A * | 8/1981 | Heine et al. | 73/434 |
| 4,406,030 | A * | 9/1983 | Platts | 15/104.061 |
| 4,839,936 | A * | 6/1989 | Prange | 15/104.33 |
| 5,203,646 | A * | 4/1993 | Landsberger et al. | 405/191 |
| 5,940,920 | A * | 8/1999 | Hare et al. | 15/88 |
| 6,956,348 | B2 * | 10/2005 | Landry et al. | 318/580 |
| 2003/0212472 | A1 * | 11/2003 | McKee | 700/245 |
| 2006/0060216 | A1 * | 3/2006 | Woo | 134/18 |
| 2006/0074525 | A1 * | 4/2006 | Close et al. | 700/245 |

OTHER PUBLICATIONS

"EPA Collection Systems O&M Fact Sheet Sewer Cleaning and Inspection", United States Environmental Protection Agency, Office of Water, EPA 832-F-99-031, Sep. 1999.

* cited by examiner

*Primary Examiner* — Michael Kornakov
*Assistant Examiner* — Natasha Campbell
(74) *Attorney, Agent, or Firm* — Reed Smith LLP

(57) ABSTRACT

Methods and tools for cleaning pipes or pipe networks based on characteristics of pipes and debris in the pipes. A mobile platform includes a cleaning head and a sensor head. The platform implements a cleaning plan and senses characteristics of the pipe and debris. The cleaning plan is incrementally updated based on the sensed characteristics, and can be automatically updated using software. Many different cleaning tasks can be accomplished using the present platforms including agitation of sediment, pulverization of large debris, and movement of debris to facilitate removal.

23 Claims, 6 Drawing Sheets

SENSOR BASED MICRO-CLEANING OF BURIED INFRASTRUCTURE

CROSS-REFERENCE TO RELATED APPLICATION

This application claims the benefit under 35 U.S.C. §119 (e) of the earlier filing date of U.S. Provisional Application Ser. No. 60/737,171 filed on Nov. 15, 2005.

BACKGROUND OF THE INVENTION

1. Field of the Invention

The present invention relates generally to devices and methods for cleaning pipes and other voids, and more specifically, the present invention is directed to robots and other mobile platforms that have sensors capable of determining characteristics of sediment and other debris within such voids and that implement cleaning plans that can be incrementally updated based upon the determined characteristics.

2. Description of the Background

As sewer systems and other pipe networks age, the risk of deterioration, blockages, and collapses becomes an ever-increasing concern. As a result, municipalities worldwide are taking proactive measures to improve performance of their sewer systems. Cleaning and inspecting sewer lines is essential to maintaining a properly functioning system; these activities further a community's reinvestment into its wastewater infrastructure.

Inspection programs are required to determine current sewer conditions and to aid in planning a maintenance strategy. Most sewer lines are inspected using one or more of the following techniques: closed-circuit television (CCTV), cameras, visual inspection, or lamping inspection.

To maintain its proper function, a sewer system needs a regular cleaning schedule. There are several traditional cleaning techniques used to clear blockages and to act as preventative maintenance tools. These techniques include mechanical, hydraulic, and chemical methods. For example, sediment and other debris can be removed from sewer systems by disturbing sediment with these methods so that sediment is transported with the sewer flow to an egress point. Additionally, debris can be physically removed from intermediate locations using devices such as bucket machines, silt traps, grease traps, or sand/oil traps.

However, each of these standard cleaning methods has the potential to damage pipes during cleaning operations. One example of damage caused by cleaning operations is from the use of steel cables in bucket cleaning systems. Moving the cleaning head back and forth during dredging operations causes the cable to "saw" into the pipe at hard angles and bends. Additionally, the repeated act of dragging the bucket through the pipe during the material transfer process can damage the pipe. Over time, cleaning damage of this type may accumulate and become a significant factor in the failure of pipe sections that require frequent cleaning. This situation is further exacerbated in that many of the cleaning methods are blind, i.e., they do not include sensing activities in the planning or execution of the cleaning operations.

Thus, traditional methods of cleaning pipes and pipe systems inefficiently clean and unnecessarily damage pipes. By integrating sensing across the spectrum of cleaning operations, the present invention more efficiently moves material while simultaneously minimizing damage to pipes. Moreover, the present devices and cleaning methodologies could be expanded to a wide variety of voids other than subterranean pipeline networks. For example, the present devices and cleaning methodologies could be used with pipes, caves, tunnels, tanks, pipelines, conduits, trenches, subterranean voids, or wells.

SUMMARY OF THE INVENTION

Micro-cleaning is the process of incremental movement of material throughout a section of buried infrastructure. Example environments include pipes, caves, tunnels, tanks, pipelines, conduits, trenches, subterranean voids, wells, etc. Material is moved by agitation at the interface of a cleaning head with the debris. The cleaning head is mounted on a mobile platform (e.g., robot, sled, tractor, float) that provides mobility, power, and structural support. Debris agitation by the cleaning head can occur through mechanical, hydraulic, pneumatic, chemical, or vibratory action. Agitated debris can be ejected or pushed away from the cleaning head via pumping, jetting, air blasting, or mechanical action.

Transfer of the debris may be aided by natural or artificial flows within the environment. For example, a cleaning head can be used to artificially increase flows within a submerged pipe to aid material transport. Similarly, air flow could be increased to augment material transfer in dry tunnels. Debris can be removed from buried infrastructure systems by moving debris to an egress point, or by moving debris to an intermediate location where other removal methods are used.

Where no flow exists in the underground infrastructure, material may be transported by one or more mobile platforms to the egress point or intermediate location. Once at the egress point or intermediate location, standard removal techniques can be used extricate the debris. The mobile platforms may operate independently or as a team or may be mechanically joined in a train. The platforms' motions and cleaning are coordinated so that debris does not accumulate in one place.

Sensors can be used to improve the efficiency of micro-cleaning operations and to minimize pipe damage.

Sensors mounted on a mobile platform with a cleaning head can be used to provide feedback regarding pipe and debris characteristics. This feedback can be used to create and implement a cleaning plan that might include features such as cleaning head selection, cleaning head position, cleaning head speed, platform speed, platform direction, material removal rates, chemical deposition rates, cable tension, and/or controllable pipe parameters (e.g., flow rate, charge level). The cleaning plan can be optimized for the sensed pipe and debris characteristics and incrementally updated to reflect changes in these characteristics.

In its many disclosed preferred embodiments, the present invention provides mobile platforms, and methods for using these mobile platforms, that use sensors in performing various types of cleaning tasks within a pipe or a network of pipes (note: for purposes of this application, the word "pipe" includes any hollow or semi-enclosed void into which a robot or other mobile platform may be inserted). These sensors determine various characteristics of sediment, obstructions, or other debris at the time and location that the work is to be performed. These characteristics might include volume, distribution, composition, particle size, density, depth, and/or hardness. Combinations of cleaning heads and sensors can be mounted on the same mobile platform, and multiple mobile platforms can be used in combination to clean a pipe or pipe network. A cleaning plan is then implemented based on the sensed characteristics and incrementally updated in response to sensed changes in the mobile platform's environment.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

Figure 1:
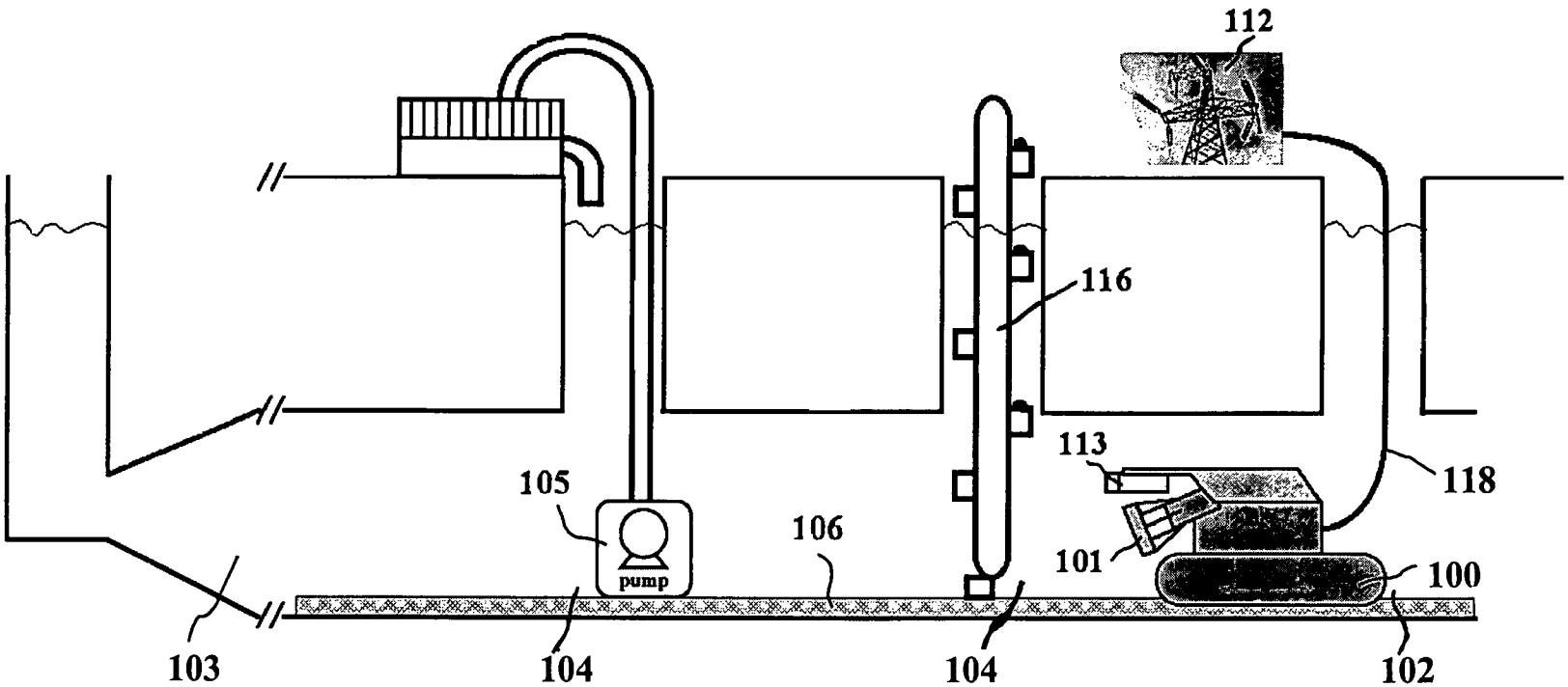
FIG. 1 shows a buried infrastructure system with intermediate and ending locations where debris can be removed from the system and an exemplary robot used to facilitate transport of debris.

It is to be understood that the figures and descriptions of the present invention have been simplified to illustrate elements that are relevant for a clear understanding of the invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description will be provided herein below with reference to the attached drawings.

The present invention, in a variety of preferred embodiments, provides mobile platforms and methods for utilizing mobile platforms that sense and determine various characteristics of the mobile platform's environment, including debris characteristics (e.g., volume, distribution, composition, particle size, density, depth, hardness), the mobile platform's position, and pipe conditions. A cleaning plan is implemented and can be updated in response to the sensed characteristics.

As cleaning progresses, sensed changes in these characteristics can be used to update the cleaning plan. For example, in a maceration operation, heavy debris is ground or crushed into material more suitable for transport. With sensor-based cleaning operations, the cleaning plan can be updated in direct response to changes in the debris characteristics. These methods can improve efficiency of cleaning and can minimize pipe damage by adapting the cleaning plan to debris characteristics.

The present invention further provides mobile platforms and methods for utilizing mobile platforms that convert electrical power to other forms of power (e.g., hydraulic, pneumatic, and/or mechanical power) that can be used to operate cleaning heads. Such conversion of electrical power increases efficiency by obviating the need for less efficient remote power sources. Traditional methods for using mobile platforms to clean pipes typically utilize above-ground pumps to power the remote cleaning head of the mobile platform. In contrast, electrical power provided to an onboard motor that operates the cleaning head can effectively operate the cleaning head using much less power than these traditional methods.

In at least one preferred embodiment, pre-cleaning inspection data is used to plan cleaning operations. Planning can include the construction of a debris catalog, which includes analysis and classification of debris composition and distribution within the pipe. The debris catalog can be input into a cleaning plan algorithm that generates a cleaning plan for optimal cleaning of debris. The cleaning plan can be customized based on factors such as pipe size, pipe condition, debris characteristics, and flow levels, to maximize material transport and minimize pipe damage. The cleaning plan might include information for how to clean different sections of pipe, including type of cleaning head to use (if the platform includes more than one cleaning head), cleaning head position, cleaning head power or speed, material removal rates, chemical deposition rates, platform speed and direction, cable tension, and/or controllable pipe parameters (e.g., flow rate, charge level).

During execution of the cleaning plan, the debris catalog can change through redistribution of debris, physical changes to the debris, and/or other changes in sensor data (e.g., more accurate data as a sensor moves closer to sensed debris, data from different sensors, data from a more detailed sensor scan). With a sensor-based cleaning operation, the cleaning plan can be updated in direct response to such changes. For example, in a maceration operation, heavy debris is ground or crushed into material more suitable for transport. While a rock crusher might be initially used for the heavy debris, sensed changes in the debris from heavy debris to crushed material can be used to update the cleaning plan such that a hydraulic or other cleaning head more appropriate for crushed material is used to complete cleaning.

FIG. 1 shows a buried infrastructure network. A mobile platform 100 with a cleaning head 101 and a sensor head 113 is placed into the buried infrastructure network to facilitate cleaning of the network. In one preferred embodiment, electrical power is supplied to the mobile platform from a remote location 112. The mobile platform 100 incrementally moves debris from starting location 102 to ending location 103 or intermediate location 104, where the debris can be removed from the network using pumps 105, mechanical elevators 116, and/or other devices.

More specifically, some embodiments of the present invention utilize micro-cleaning methods to agitate, suspend and move debris 106 to facilitate its removal from pipes or other underground structures. The mobile platform 100 receives electrical power from a remote location 112 via a cable tether 118. Electrical power is converted to hydraulic, pneumatic, mechanical, or other power forms at the mobile platform 100 for the purpose of moving debris 106 in an incremental fashion from a starting location 102 to intermediate location(s) 104 and/or ending location 103.

In one preferred embodiment, the mobile platform 100, cleaning head 101, and sensor head 113 are controlled from remote location 112. The sensor head 113 provides near real time data about debris 106 conditions and location, providing feedback necessary for closed loop control of the debris agitation and suspension process. This closed loop control strategy reduces the workload of the mobile platform operator and increases efficiency of the operation. It also enables automated and intelligent cleaning that does not require constant operator attention.

In one particular embodiment, software can be used in conjunction with feedback to automate the cleaning of various environments. A controller using such software controls the mobile platform 100 and cleaning head 101. The controller and software can use mobile platform position feedback and sensor head feedback data to automatically aim or direct the cleaning head 101 for best results. Other examples of responding to such feedback include adjusting the location of the mobile platform, speed of the mobile platform, direction of the mobile platform, cleaning head position, cleaning head power, type of cleaning tool to use, material removal rates, chemical deposition rates, and/or cable tension.

For example, the controller could alter the mobile platform's direction and cleaning head 101 to target debris at a location indicated by feedback from the sensor head 113. As sensor feedback indicates changes in debris characteristics, the controller can use software to adjust the mobile platform and cleaning head. For example, if sensor feedback indicates a decrease in depth and/or hardness of sediment, the controller can decrease the power of the cleaning tool. Similar adjustments could be made if, for example, sensor feedback indicates changes in debris characteristics from one section of pipe to another section as the mobile platform moves through a pipe. Such closed loop feedback can optimize the cleaning operation throughout a pipe or pipe network.

Examples of software that can be used by a controller include scripts, expert systems, learning methods, and set plays. With scripts, a predefined set of actions is initiated based on a set of operating parameters such as pipe size, sediment level, and/or sediment density. For example, a basic cleaning script might include software commands to make the platform lower its cleaning head, turn the cleaning head on, move the cleaning head left and right by a distance related to the pipe diameter and sediment level, repeat these actions a certain number of times, lower the cleaning head, repeat the movement of the cleaning head left and right a certain number of times, stop the cleaning head, take a new sensor reading, and move forward a certain distance. In a script, pre-defined actions occur without closed loop feedback. The script runs until completion or failure.

In expert systems, mobile platform actions are planned with the aid of sensors and a knowledge base of the system process, for example sediment removal. In one embodiment utilizing a robot, the knowledge base is developed by carrying out in-depth study of the process using sensors and human interpretation that may not be available to the robot. During operations, a sonar sensor observes variations in sediment deposition that are a result of cleaning motions being used. New cleaning paths and techniques can be implemented based on the knowledge base to make cleaning more effective. This allows some use encoded knowledge to improve robotic operations and effectiveness.

In learning methods, a behavior-based control system improves automated cleaning algorithms or cooperation among robots in a group. Learning methods provide each robot with the adaptability necessary for coping with a dynamically changing environment, effectively providing on-line optimization of activities such as debris suspension, debris transport, and debris removal. The net effect on a group of robots can be the optimization of an entire process.

In set plays, a high-level command is given to robots that require minimum human attention. These are similar to plays that a football team would call. Each player or robot knows the broad outline of the play which has been well-practiced. The set play can be tailored by adding constraints, setting parameters, or defining operating conditions. This essentially provides adjustable autonomy for the robots. For example, the command to "clean" can be issued while leaving out the details of how to clean, such as the required cleaning head motion.

In an alternate embodiment, an operator controls the mobile platform 100 and cleaning head 101. The operator monitors the sensor head feedback and makes decisions of where and how to clean based on his interpretation of the sensor head data. The operator receives sensor feedback via a communication link in tether 118.

In at least one preferred embodiment, the sensor head 113 is an imaging sonar sensor, which provides the depth and form of the debris 106 and pipe in front of the mobile platform 100. Other sensors such as profiling sonar sensors, lasers, cameras, and density meters can be used to provide additional information regarding debris 106 and pipe characteristics, allowing optimization of debris removal strategies. A fused sensor strategy, in which different types of sensors are used in combination, can also be used to provide a more complete debris catalog.

Different embodiments can use various cleaning methods, including hydraulic, pneumatic, mechanical, chemical, or vibratory methods of disturbing and moving debris. At least one embodiment utilizes a multi-modal strategy, in which combinations of cleaning heads can be activated using feedback from the sensor head 113 to enable intelligent material transfer. This kind of control enables in-situ optimization of the cleaning method as a function of the local environment.

A combination of these cleaning methods can be used to optimize cleaning for a particular environment. For example, mechanical power to break up hard sediment can be combined with hydraulic power to re-suspend broken-up sediment to promote sediment movement. If particle size in a particular area is too large for suspension or pumping, a rock crusher could be engaged in that area. This use of combined power forms can be accomplished by using one mobile platform with multiple cleaning heads, or by using multiple mobile platforms with different cleaning capabilities.

Figure 6:
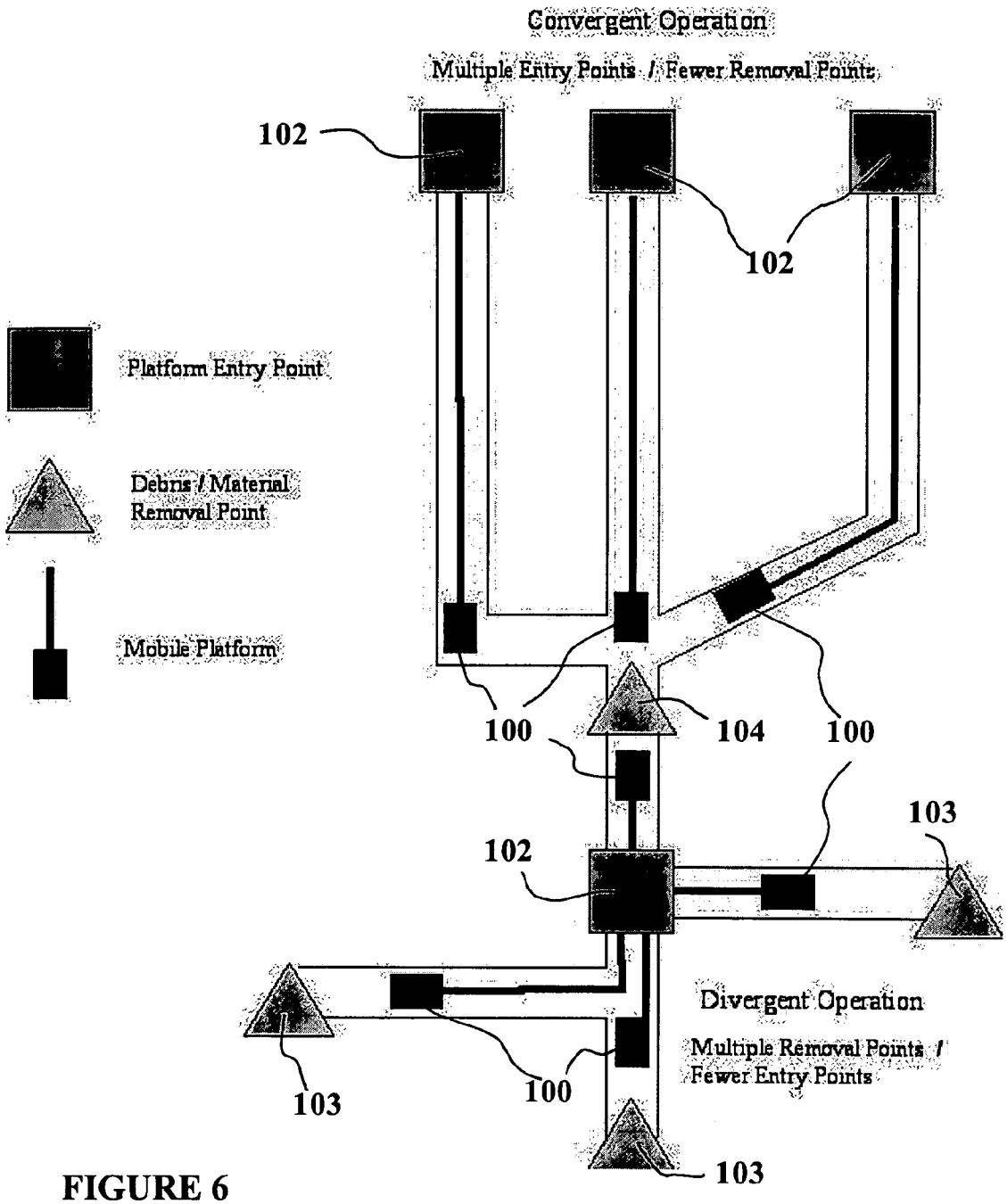
FIG. 6 is a schematic diagram of a system of multiple mobile platforms used to clean a pipe network.

Further, multiple mobile platforms can be placed simultaneously into a pipe or pipe network such that aggregate material transfer rates from starting location 102 to intermediate location 104 or ending location 103 is continuous and maximized, thus accelerating the removal process. FIG. 6 illustrates a system of using multiple mobile platforms 100. In a convergent cleaning operation, multiple mobile platforms can be placed at different starting locations 102 to move debris to a common intermediate location 104 or ending location 103 from which debris can be removed from the pipe or pipe network. In a divergent cleaning operation, multiple mobile platforms can be deployed at one starting location 102 to move debris to different intermediate 104 or ending locations 103 from which debris can be removed.

In larger scale cleaning operations, it may be beneficial to deploy and control a plurality of mobile platforms to best coordinate debris transfer and removal. The mobile platforms may operate independently or as a team or may be mechanically joined in a train. In multiple platform operations, each platform may have its own sensor and cleaning heads along with control software to optimize local area debris transfer. Each platform maintains a debris catalog which is updated with each new sensor reading. Debris catalogs from each mobile platform can be combined into a master catalog that is used by top-side supervisory control software to coordinate the work of the multiple platforms. This is done for system-wide, instead of merely local, optimization of debris removal. For example, the platforms' motions and cleaning can be coordinated so that debris does not accumulate in one place.

A variety of methods can be used alone or in combination to remove debris from a pipe network. As shown in FIG. 1, at intermediate location(s) 104, pumps 105, mechanical elevators 116, or other devices can be used to remove debris 106 from the underground structure. These devices transport the debris vertically to separate solids and return liquids back to the underground structure. Alternatively, and where no intermediate location is available, debris may be incrementally moved to the ending location 103 for removal.

Figure 2:
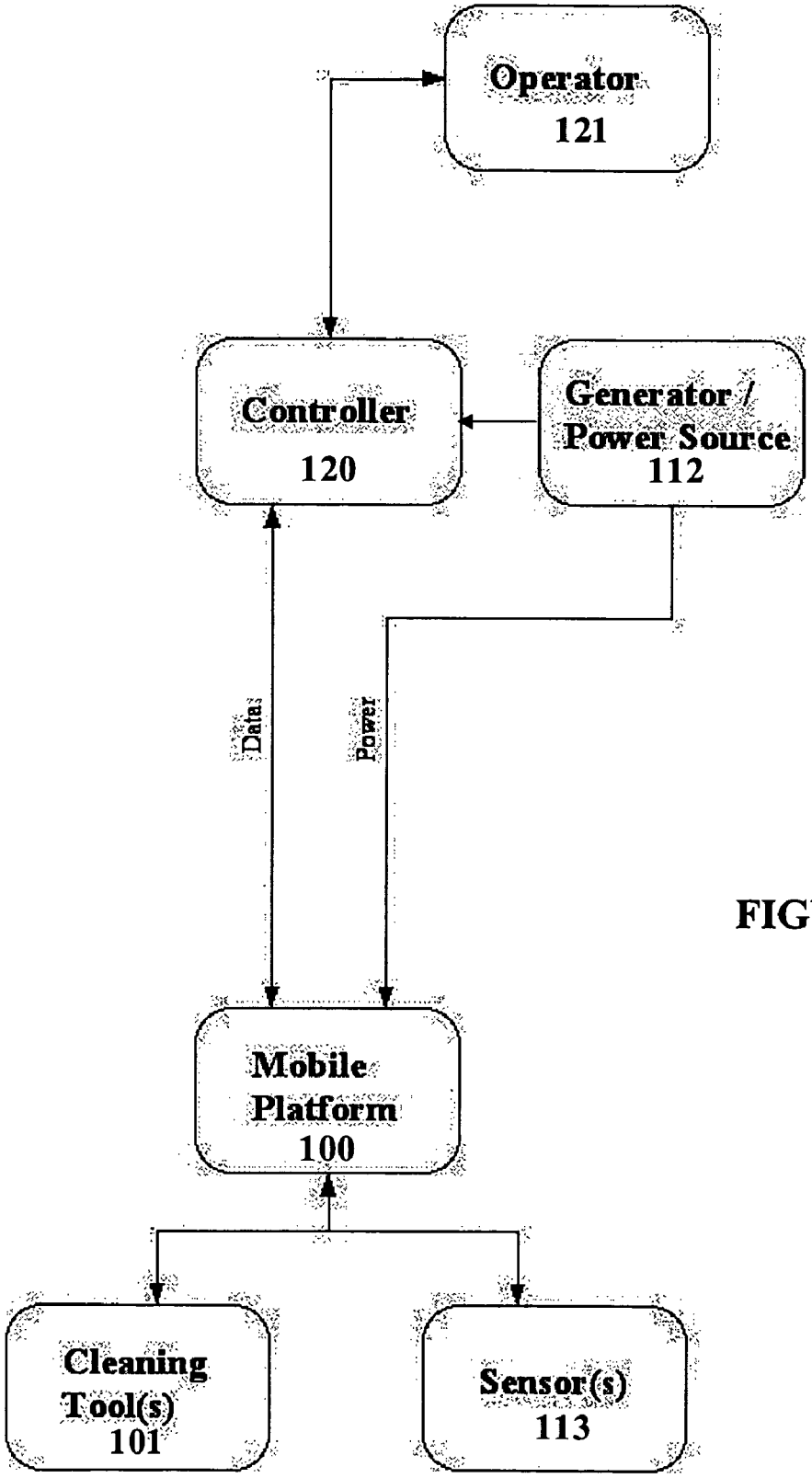
FIG. 2 is a schematic diagram of an exemplary mobile platform with onboard cleaning tool(s) and sensor(s) and a remote power source and a controller monitored by an operator.

FIG. 2 provides a schematic diagram of an exemplary mobile platform 100 with on-board cleaning tool 101 and sensor(s) 113. A power source 112, such as a generator, provides electrical power from a remote location to the mobile platform. A controller 120 in communication with the mobile platform 100 receives data from sensor(s) 113 and transmits data to the mobile platform 100, cleaning tool 101, and/or sensor(s) 113. The controller 120 can be located remotely or on the mobile platform 100. Further, the mobile platform 100 can contain an on-board controller that controls local cleaning, while a remote controller simultaneously manages system-wide. An operator 121 can monitor or operate the controller 120.

Figure 3:
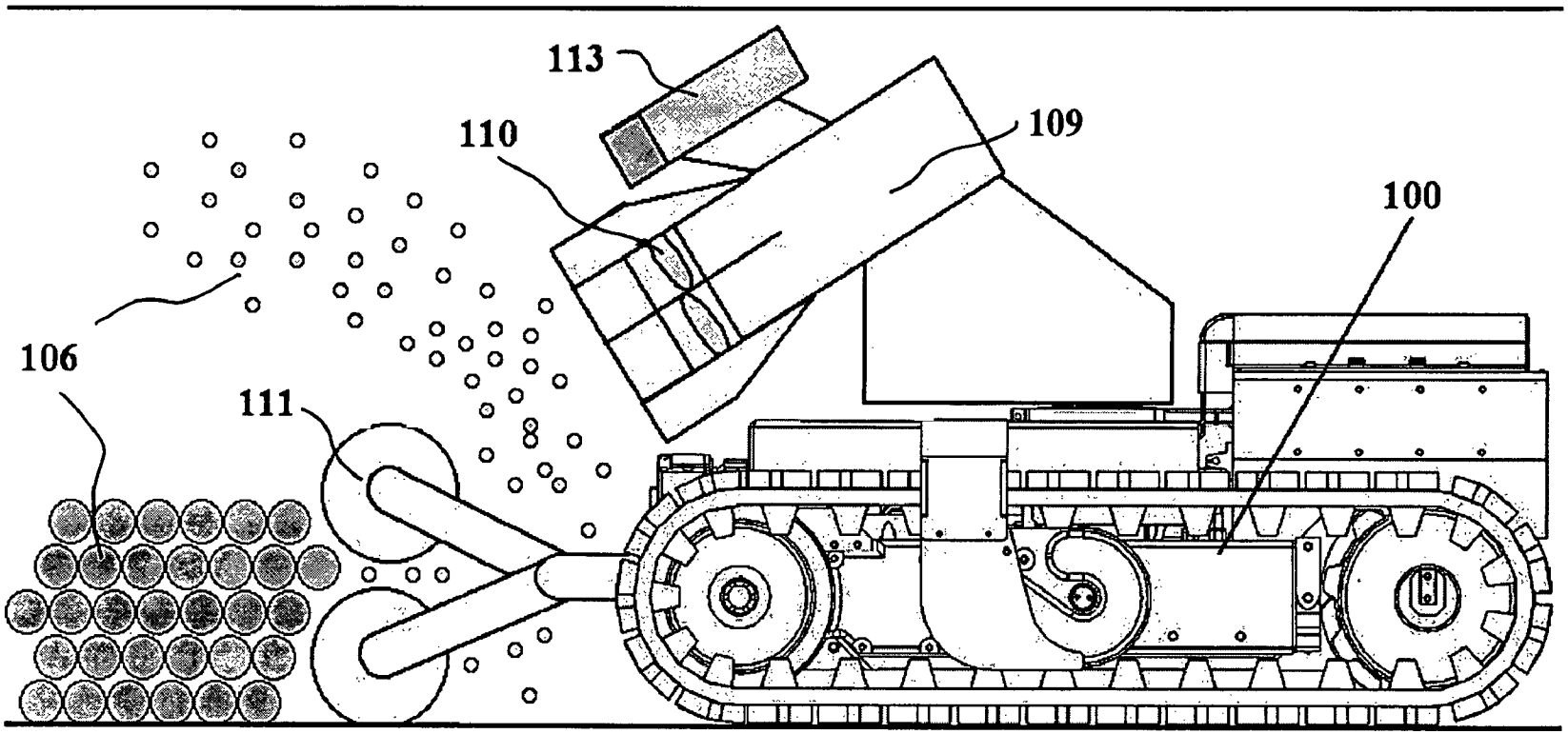
FIG. 3 shows an exemplary mobile platform with a sensor head, a hydraulic or pneumatic cleaning head and a size reduction device.

FIG. 3 shows an exemplary embodiment of an apparatus that converts electrical power to hydraulic or pneumatic power for debris 106 removal. The apparatus includes a mobile platform 100, a cleaning head 109 with impeller 110, and a sensor head 113. In a preferred embodiment, an impeller 110 driven by an electric motor is shown. Alternative and additional hydraulic or pneumatic cleaning heads 109 include flow redirection devices, flow restriction devices, pumps, propellers, and other hydraulic or pneumatic devices.

Primarily targeted at submerged or partially submerged environments, this method uses surrounding fluid media (e.g., water in a sewer pipe) as a means to agitate debris. Electrical power is preferably transmitted from a remote location via a tether. The power is then converted by an onboard electric motor to provide rotary motion of the impeller 110. Rotary motion of the impeller creates a hydraulic or pneumatic flow, which imparts energy on the sediment 106. In dry environments, the flow can be air. In wet and submerged environments, the flow can be water or any other fluid. The energy of the fluid flow provides force to re-suspend debris 106 into the existing pipe flow, thereby moving debris 106 downstream.

Where no existing pipe flow is present, the fluid flow created by the impeller can move the debris to a location for removal. Additionally, a mobile platform can transport the debris to a location for removal. For example, debris may be scooped up or loaded onto a mobile platform by various methods. In one embodiment, a backhoe-like arm with bucket could reach in front of or behind the mobile platform, scoop up debris, and place it into a debris container on the platform. In another embodiment, the mobile platform includes a clam shell bucket. To scoop up material, the clam shell opens and is driven downwards into the debris. As it digs into the debris, the clam shell is closed and the debris is captured inside. The clam shell bucket is then raised and the debris is ready for transport. The platform can then deposit the debris at a location for removal by simply opening the clam shell and allowing the debris to fall through the bottom of the clam shell. Once at the removal location, standard removal techniques can be used to extricate the debris.

Where hydraulic or pneumatic power for re-suspension is insufficient to move large and heavy debris, a size reduction device 111, such as a rock crusher shown in FIG. 3, can be employed. The rock crusher 111 is a mechanical device that can pulverize large rock or other debris into smaller particles or fine sediment for easier re-suspension and transport. This size reduction device 111 can be used in conjunction with any or all of the methods used to move debris.

Figure 4:
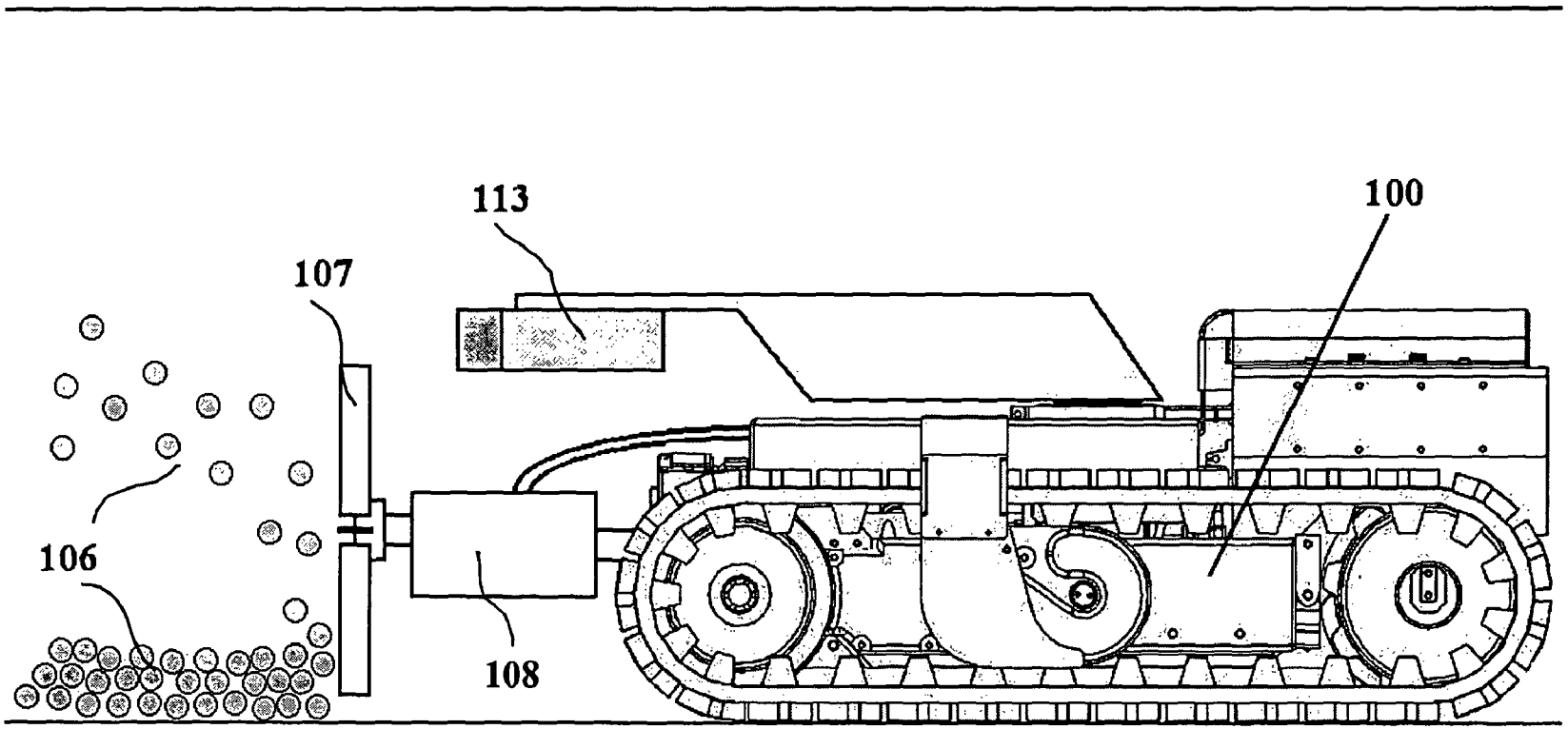
FIG. 4 shows an exemplary mobile platform with a sensor head and a mechanical cleaning head.

FIG. 4 shows an embodiment of an apparatus that converts electrical power to mechanical power for debris removal. The apparatus includes a mobile platform 100, a mechanical cleaning head 108 with flails 107, and a sensor head 113. In a preferred embodiment, flails 107 are rigid members attached to a rotating disc. Alternatively, the flails 107 could be made of heavy steel cable, link chain, or other material of sufficient mass to effectively impart mechanical energy to sediment 106. Augers, screws, impact hammers, and vibration devices are some examples of devices used with other embodiments that use mechanical power for debris removal.

Electrical power is transmitted from a remote location 112 via a tether. The power is then converted by an onboard electric motor to provide rotary motion of the flails 107. The flails 107 provide high-torque mechanical power, which impacts debris 106 to break up and loosen the material. The flails 107 may also impart enough energy to re-suspend debris 106 into the existing underground structure flow, thereby moving the debris downstream. Where no existing pipe flow is present, the mobile platform can transport the debris to a location for removal.

Figure 5:
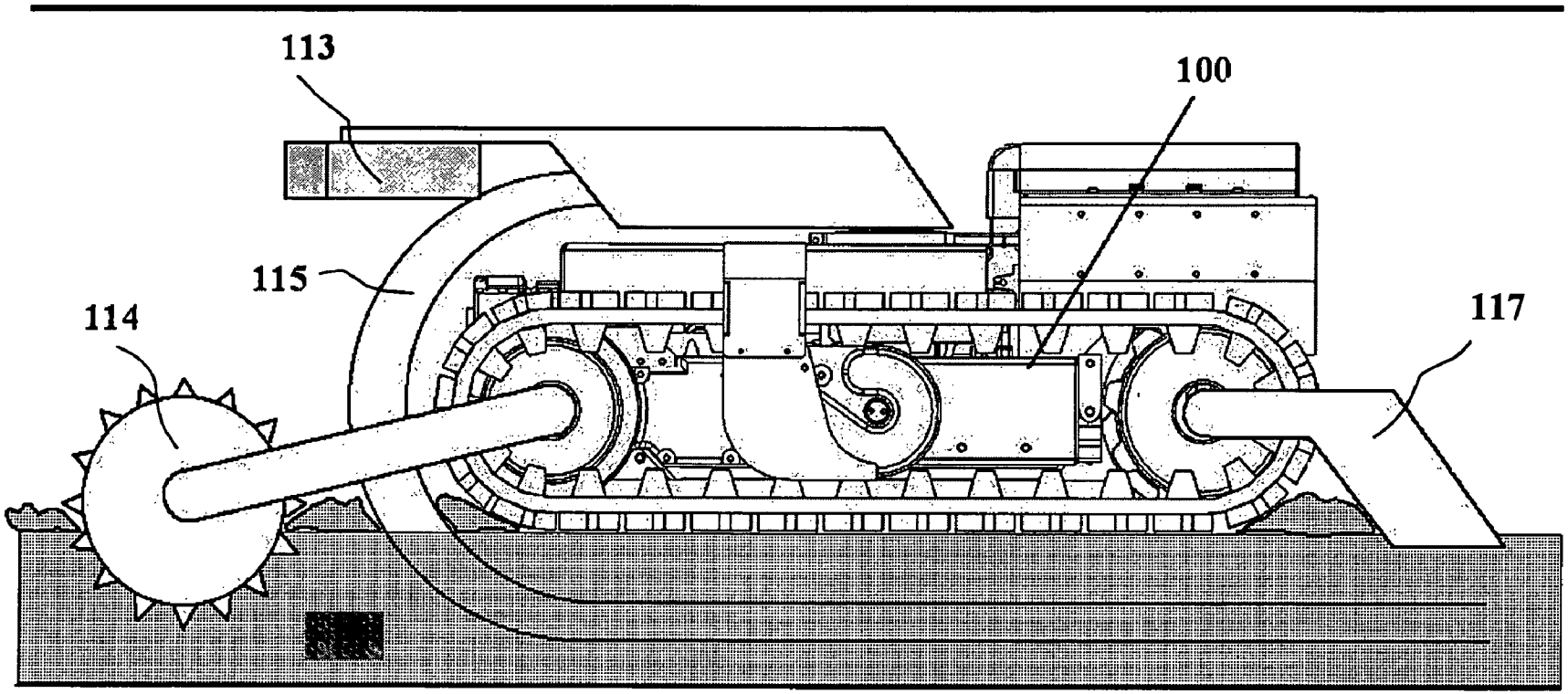
FIG. 5 shows a mobile platform with a sensor head, a trenching head and a permeable air hose used to disturb sediment using pneumatic power.

FIG. 5 shows an embodiment of the present invention that uses remote pneumatic power for debris removal. The apparatus includes a mobile platform 100, a trenching head 114, and a sensor head 113. In a preferred embodiment, the trenching head 114 digs a trench in sediment 106 while the mobile platform 100 places a permeable air hose 115 into the trench and covers it over (via 117). The mobile platform 100 installs a length of permeable hose 115 equal to the distance the mobile platform 100 can travel. After the hose is installed, the mobile platform 100 is removed from the underground structure.

Next, an air compressor at a remote location is used to generate air pressure and flow sent through the permeable air hose 115. The air exits perforations in the hose and seeps into the interstices of the sediment. The buoyant force of the air bubbles breaks up the compacted sediment 106 and loosens its surrounding bonds. The exiting air can also create a low friction boundary layer between the pipe and sediment so that normal pipe flow may be sufficient for material transport. Airflow and pressure are increased as a function of depth below the water surface and depth of sediment 106 to be removed.

In one embodiment, the trenching head 114 contains a rotating wheel with angled teeth. The trenching head 114 is driven downwards to dig a narrow trench as the wheel rotates and the mobile platform moves forward. Angled teeth on the rotating wheel cause loosened debris to form piles on either side of the trench similar to a plowing operation. The hose 115 is stored on the platform and is laid into the trench. A back filling attachment 117 at the back of the mobile platform then preferably pushes the piles of sediment back into the trench and over the top of the hose. This is done continually as the platform moves forward.

In another embodiment where space does not allow onboard storage, the platform drags the air permeable hose into the trench as the platform moves forward. After the hose is dragged into place, the trenching head is positioned at the surface of the debris. Debris is then back filled into the trench by reversing the trenching head direction and moving the platform backwards.

Through the above examples, various mobile platforms and cleaning methods have been described for performing work within a pipe or pipe network. Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A method for cleaning a pipe, the method comprising the steps of:

automatically cleaning a first portion of the pipe with a cleaning tool of a mobile platform in accordance with an initial cleaning plan, wherein the mobile platform is:

positioned in the pipe; and configured to traverse through the pipe;

sensing a change in a characteristic of debris in the pipe with a sensor of the mobile platform; and automatically adjusting said cleaning plan at the mobile platform based on the sensed change, wherein the step of automatically adjusting said cleaning plan comprises utilizing a controller communicatively connected to the cleaning tool and the sensor and configured to automatically adjust said cleaning plan based on the sensed change.

2. The method of claim 1, further comprising:

repeating said steps of cleaning, sensing, and adjusting.

3. The method of claim 1, wherein said sensor comprises a sonar sensor.

4. The method of claim 1, wherein said sensor comprises a laser.

5. The method of claim 1, wherein said sensor comprises a camera.

6. The method of claim 1, wherein said sensor comprises a density meter.

7. The method of claim 1, wherein said cleaning tool comprises a plurality of cleaning tools, and further wherein said initial cleaning plan comprises selection of one of said plurality of cleaning tools.

8. The method of claim 1, wherein said cleaning tool comprises a hydraulic cleaning tool.

9. The method of claim 1, wherein said cleaning tool comprises a pneumatic cleaning tool.

10. The method of claim 1, wherein said cleaning tool comprises a mechanical cleaning tool.

11. The method of claim 1, wherein said cleaning tool comprises a trenching tool.

12. The method of claim 1, wherein said cleaning tool comprises a chemical cleaning tool.

13. The method of claim 1, wherein said initial cleaning plan comprises a determination of the amount of power at which to operate said cleaning tool.

14. The method of claim 1, wherein said step of adjusting said cleaning plan comprises changing the speed of said cleaning tool.

15. The method of claim 1, wherein said step of adjusting said cleaning plan comprises changing the direction of said cleaning tool.

16. The method of claim 1, wherein said initial cleaning plan is devised based on an inspection of said pipe.

17. A mobile platform for cleaning a pipe, comprising:

a housing, wherein the housing is configured to traverse through the pipe;

at least one cleaning tool attached to said housing;

at least one sensor attached to said housing for gathering information regarding a characteristic of debris in the pipe; and a controller communicatively connected to each cleaning tool of the mobile platform, wherein the controller is configured to:

automatically adjust a cleaning plan at the mobile platform based on the gathered information; and automatically calculate adjustments to operation of said mobile platform in accordance with the adjusted cleaning plan.

18. The mobile platform of claim 17, wherein said sensor comprises a sonar sensor.

19. The mobile platform of claim 17, wherein said cleaning tool comprises a plurality of cleaning tools.

20. The method of claim 1, wherein automatically cleaning the first portion of the pipe comprises automatically cleaning the first portion of the pipe while the mobile platform is moving in the pipe.

21. The method of claim 1, wherein sensing a change in a characteristic of the debris comprises sensing at least one of the following:

a volume of the debris;

a distribution of the debris;

a composition of the debris;

a particle size of the debris;

a density of the debris;

a depth of the debris; and a hardness of the debris.

22. The method of claim 1, further comprising automatically cleaning a second portion of the pipe based on the adjusted cleaning plan.

23. The method of claim 22, wherein automatically cleaning the second portion of the pipe comprises automatically cleaning the second portion of the pipe with a second cleaning tool of the mobile platform.

* * * * *